US011716582B1

(12) United States Patent
Chen

(10) Patent No.: US 11,716,582 B1
(45) Date of Patent: Aug. 1, 2023

(54) LOUDSPEAKER VIBRATING MEMBRANE WITH HARD PROPERTY AND ELASTIC SOFT PROPERTY AND METHOD FOR MANUFACTURING THE SAME

(71) Applicant: Vincent Chen, Taipei (TW)

(72) Inventor: Vincent Chen, Taipei (TW)

( * ) Notice: Subject to any disclaimer, the term of this patent is extended or adjusted under 35 U.S.C. 154(b) by 0 days.

(21) Appl. No.: 17/583,910

(22) Filed: Jan. 25, 2022

(51) Int. Cl.
*H04R 31/00* (2006.01)
*H04R 7/14* (2006.01)
*H04R 7/12* (2006.01)

(52) U.S. Cl.
CPC ..... *H04R 31/003* (2013.01); *H04R 7/125* (2013.01); *H04R 7/14* (2013.01); *H04R 31/006* (2013.01); *H04R 2307/025* (2013.01)

(58) Field of Classification Search
CPC ..... H04R 7/125; H04R 2307/025
See application file for complete search history.

(56) References Cited

FOREIGN PATENT DOCUMENTS

CN 109417670 B * 9/2021 ..... B29C 48/0021

* cited by examiner

*Primary Examiner* — Sunita Joshi
(74) *Attorney, Agent, or Firm* — Lin & Associates Intellectual Property, Inc.

(57) ABSTRACT

A method for manufacturing a loudspeaker vibrating membrane with hard and elastic soft properties, comprising: (a) adhering a curable polymer to all areas on the outer surface of a base material; (b) drying the curable polymer to form a hard structure; (c) forming a loudspeaker vibrating membrane; and (d) separating the loudspeaker vibrating membrane from the base material. The method further comprises the following steps between steps (b) and (c) or steps (c) and (d), or after step (d): (e) adhering an elastic soft polymer to all or partial areas on the outer surface of the hard structure; and (f) drying the elastic soft polymer to form an elastic soft structure covering all or partial areas on the outer surface of the hard structure. In the present invention, the hardness and elastic coefficient of the loudspeaker vibrating membrane can be adjusted by the hard structure and the elastic soft structure.

8 Claims, 16 Drawing Sheets

S300

S300

S300

S300

LOUDSPEAKER VIBRATING MEMBRANE WITH HARD PROPERTY AND ELASTIC SOFT PROPERTY AND METHOD FOR MANUFACTURING THE SAME

BACKGROUND OF THE INVENTION

1. Field of the Invention

The present invention relates to a loudspeaker vibrating membrane with hard property and elastic soft property and a method for manufacturing the same.

2. The Prior Arts

Conventional methods for manufacturing a loudspeaker vibrating membrane comprise the following steps: impregnating a base material in a curable polymer; drying the base material, such that the curable polymer is dried to form a hard structure covering the outer surface of the base material; forming a loudspeaker vibrating membrane on the base material by pressing; and separating the loudspeaker vibrating membrane from the base material. The loudspeaker vibrating membrane comprises a main body and a hard structure, wherein the hard structure covers the outer surface of the main body.

Since the base material is usually cloth and has a soft texture, the loudspeaker vibrating membrane manufactured therefrom also has a soft texture. The hardness of the entire loudspeaker vibrating membrane can be increased by the hard structure, so that the loudspeaker vibrating membranes are capable of generating vibration when receiving the operation of the voice coil.

However, the hard structure is susceptible to factors such as vibration, fatigue stress and heat, thereby causing problems such as hardening and aging. As the degrees of hardening and aging of the hard structure is higher, the hardness of the loudspeaker vibrating membrane is greater, thereby resulting worse fatigue resistance and elastic resilience of the loudspeaker vibrating membrane. Therefore, as the time period where the loudspeaker vibrating membrane being used is longer, the loudspeaker vibrating membrane intends to lack elasticity, and is even prone to be fatigued, ruptured, deformed and peeled off, thereby affecting the output sound quality.

Furthermore, the materials of the base material and the hard polymer are completely different, which results in the different vibration frequencies of the main body and the hard structure, therefore, the loudspeaker vibrating membrane is prone to generate resonance noise, thereby resulting in many problems such as large extent of noise, difficult displaying of sound channel at low frequency, poor loaded resilience and poor output sound quality.

SUMMARY OF THE INVENTION

A main objective of the present invention is to provide a loudspeaker vibrating membrane with hard property and elastic soft property and a method for manufacturing the same, wherein the hardness and the elastic coefficient of all or partial areas of the loudspeaker vibrating membrane can be adjusted.

In order to achieve the aforementioned objectives, the present invention provides a method for manufacturing a loudspeaker vibrating membrane with hard property and elastic soft property, comprising the following steps: (a) impregnating a base material in a curable polymer, such that the curable polymer adheres to all areas on an outer surface of the base material, wherein the base material has at least one preformed portion; (b) drying the base material, such that the curable polymer is dried to form a hard structure covering all areas on the outer surface of the base material; (c) performing heating and pressing on the at least one preformed portion to form a loudspeaker vibrating membrane; and (d) separating the loudspeaker vibrating membrane from the base material. Wherein, the method further comprises the following steps between the step (b) and the step (c), or between the step (c) and the step (d), or after the step (d): (e) adhering an elastic soft polymer to all or partial areas on an outer surface of the hard structure by technical means such as screen printing, spray coating, artificial coating, sticking, impregnating or mask coating; and (f) drying the base material, such that the elastic soft polymer is dried to form an elastic soft structure covering all or partial areas on the outer surface of the hard structure.

In some embodiments, the step (e) and the step (f) are performed only once or repeated a plurality of times, so as to form a single layer or a plurality of layers of the elastic soft structure covering all or partial areas on the outer surface of the hard structure.

In order to achieve the aforementioned objectives, the present invention provides a method for manufacturing a loudspeaker vibrating membrane with hard property and elastic soft property, comprising the following steps: (a) mixing a curable polymer and an elastic soft polymer to prepare a composite polymer, and adhering the composite polymer to all areas on an outer surface of a base material, wherein the base material has at least one preformed portion; (b) drying the base material, such that the composite polymer is dried to form a composite structure covering all areas on the outer surface of the base material; (c) performing heating and pressing on the at least one preformed portion to form a loudspeaker vibrating membrane; and (d) separating the loudspeaker vibrating membrane from the base material.

In some embodiments, the step (a) and the step (b) are performed only once or repeated a plurality of times, so as to form a single layer or a plurality of layers of the composite structure covering all areas on the outer surface of the base material.

In order to achieve the aforementioned objectives, the present invention provides a loudspeaker vibrating membrane with hard property and elastic soft property, comprising a main body, a hard structure and an elastic soft structure 33. The hard structure is formed by drying a curable polymer and covers all areas on an outer surface of the main body. The elastic soft structure is formed by drying an elastic soft polymer and covers all or partial areas on an outer surface of the hard structure.

In some embodiments, a single layer or a plurality of layers of elastic soft structure cover(s) all or partial areas on the outer surface of the hard structure.

In order to achieve the aforementioned objectives, the present invention provides a loudspeaker vibrating membrane with hard property and elastic soft property, comprising a main body and a composite structure. The composite structure is formed by drying a composite polymer and covers all areas on an outer surface of the main body. Wherein, the composite polymer is composed of a curable polymer and an elastic soft polymer.

In some embodiments, a single layer or a plurality of layers of composite structure cover(s) all areas on the outer surface of the main body.

The present invention has the effect in that the hardness and elastic coefficient of all or partial areas of the loudspeaker vibrating membrane can be adjusted by the structure formed of the curable polymer, the elastic soft polymer or the composite polymer.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

FIGS. 1 to 4 are a flow chart and schematic views of steps S100 to S600 of the first embodiment of the method of the present invention, respectively. As shown in FIGS. 1 to 4, the present invention provides a method for manufacturing a loudspeaker vibrating membrane with hard property and elastic soft property, comprising steps S100 to S600.

Figure 1:
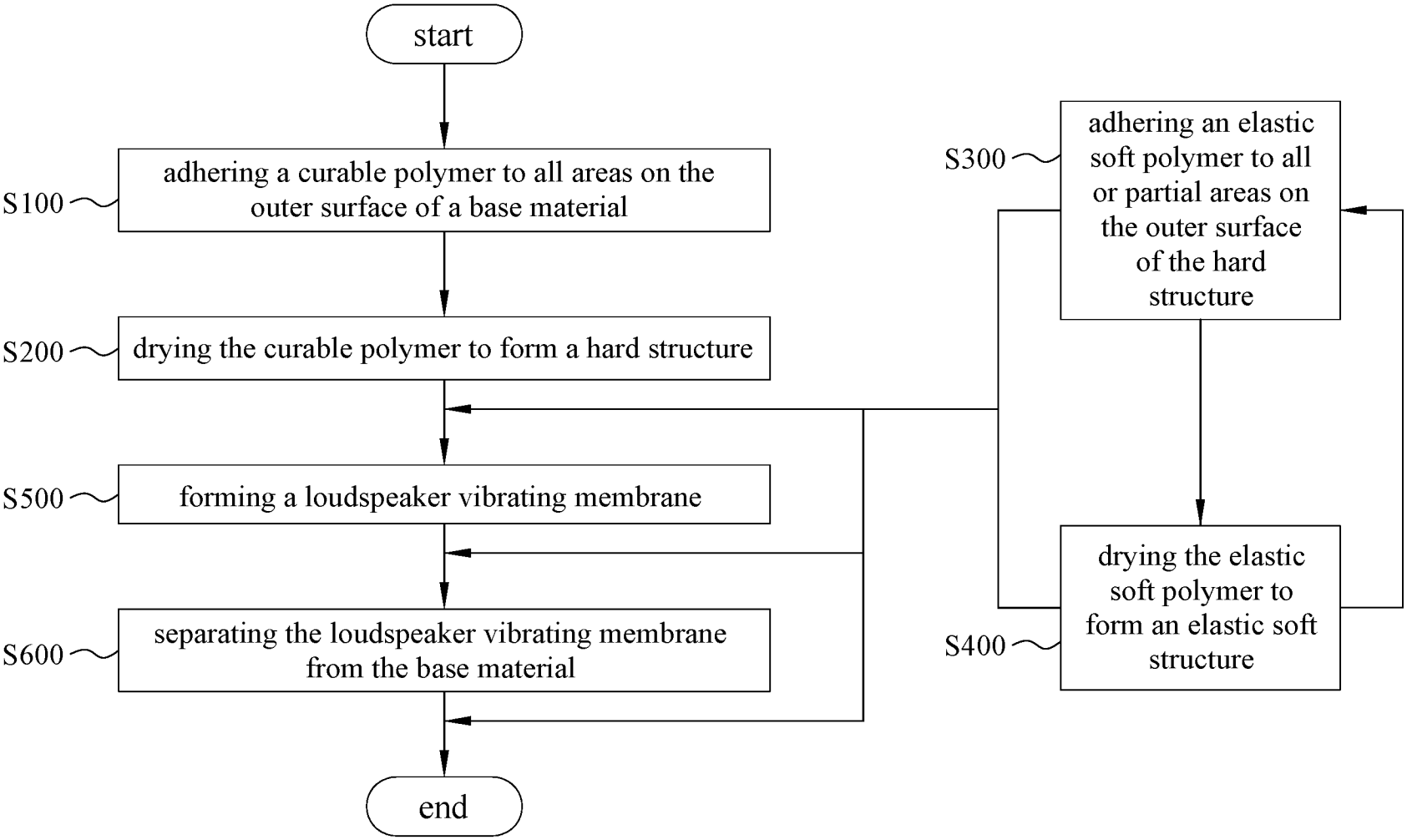
FIG. 1 is a flow chart of the first embodiment of the method of the present invention.
Figure 2:
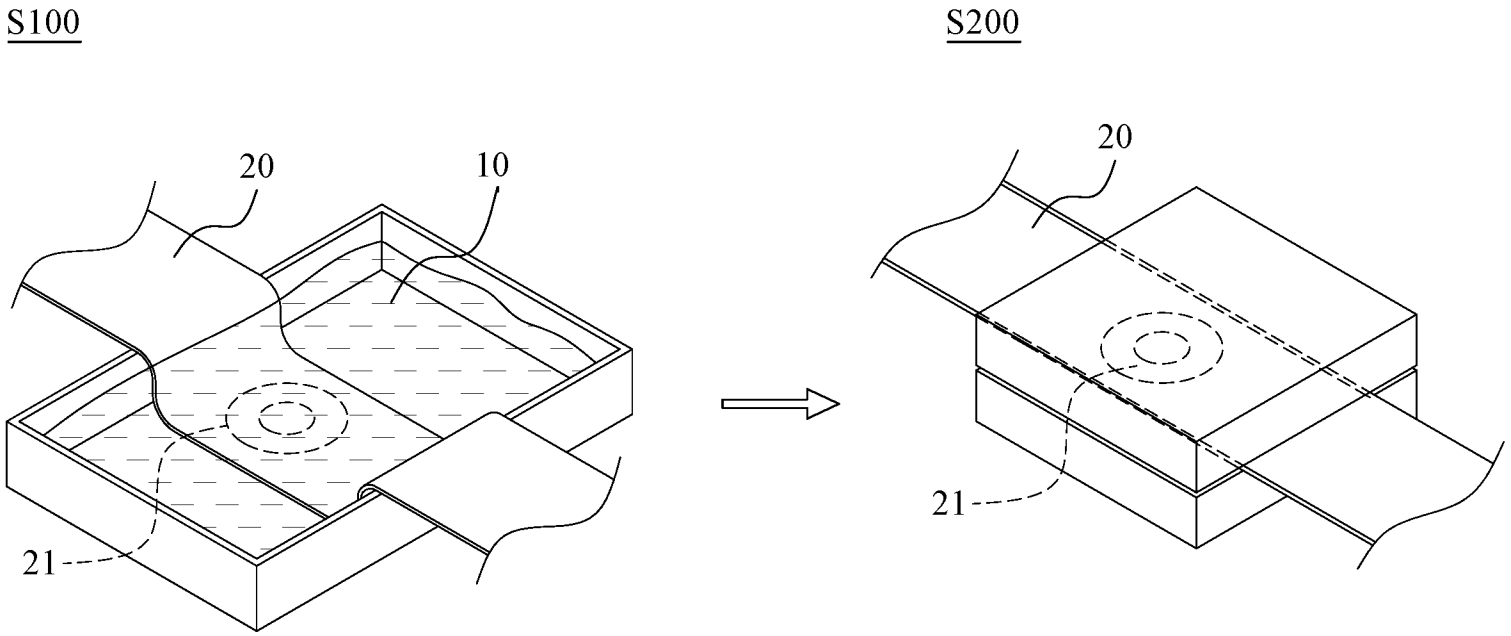
FIGS. 2 to 4 are schematic views of steps S100 to S600 of the first embodiment of the method of the present invention.

In the step S100, as shown in FIGS. 1 and 2, a base material 20 is impregnated in a curable polymer 10, such that the curable polymer 10 adheres to all areas on an outer surface of the base material 20, wherein the base material 20 has a plurality of preformed portions 21.

In the step S200, as shown in FIGS. 1 and 2, the base material 20 is dried, such that the curable polymer 10 is dried to form a hard structure 32 (referring to FIGS. 5 to 10) covering all areas on the outer surface of the base material 20.

Figure 3A:
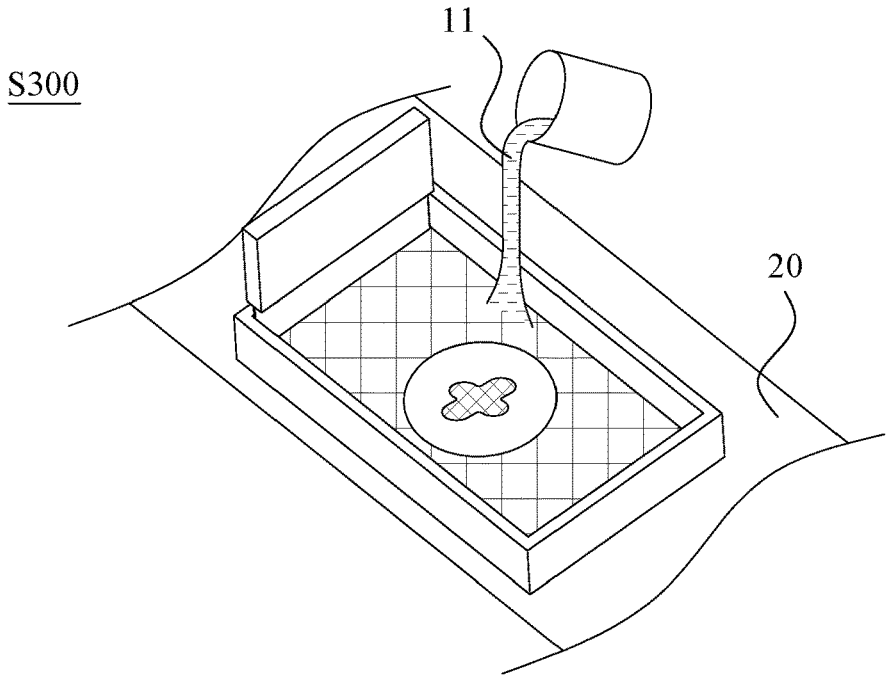
Figure 3B:
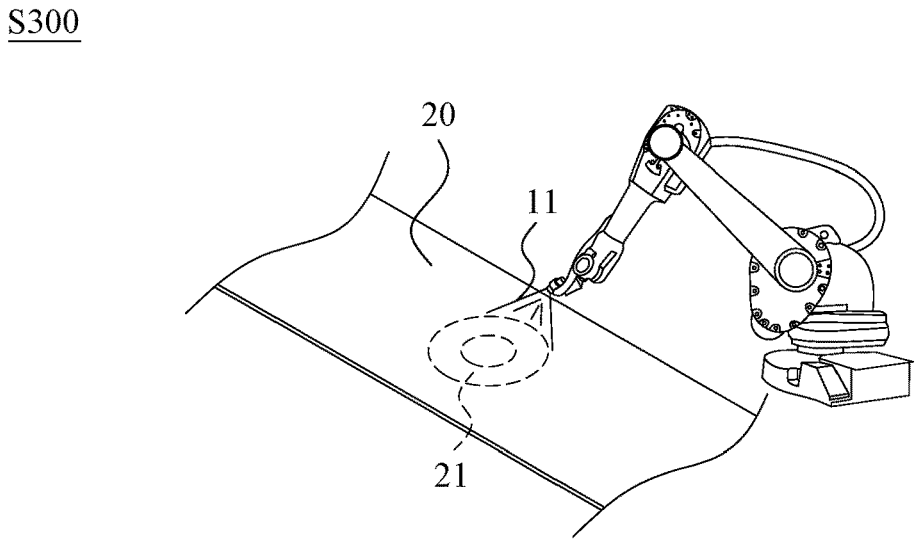
Figure 3C:
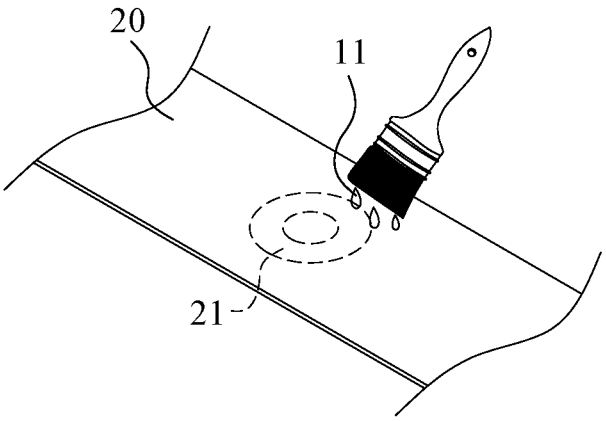
Figure 3D:
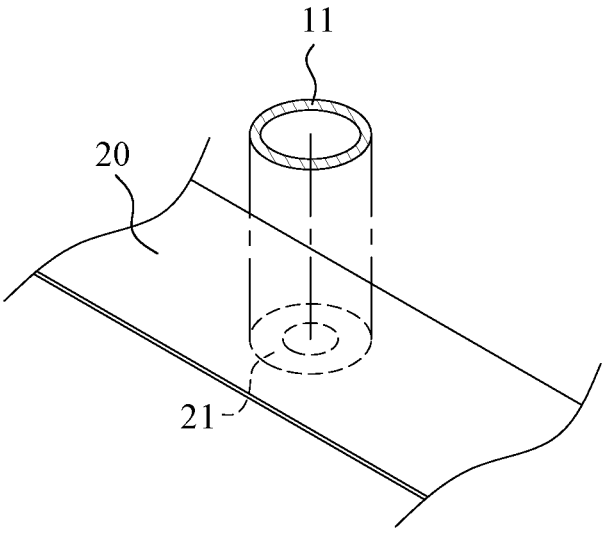
Figure 3E:
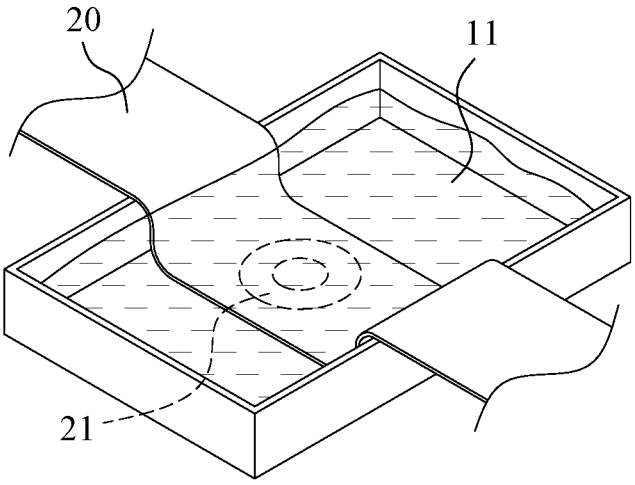
Figure 3F:
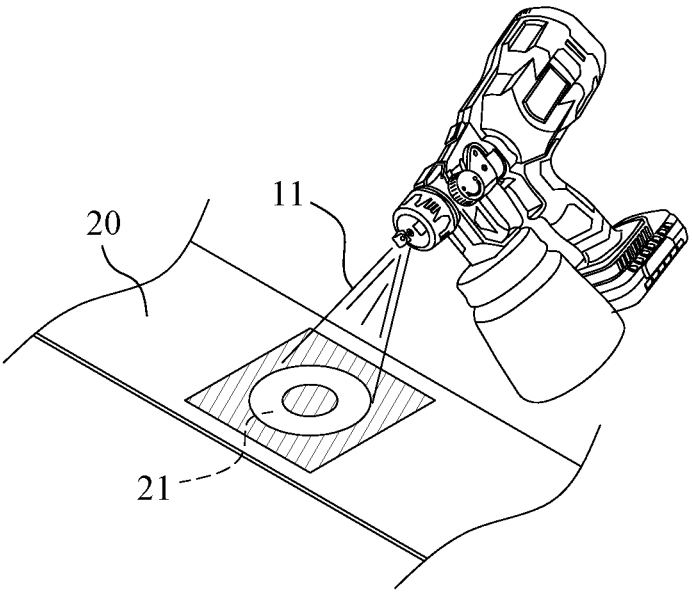

In the step S300, as shown in FIGS. 1 and 3A to 3F, an elastic soft polymer 11 adheres to all or partial areas on an outer surface of the hard structure 32 by technical means such as screen printing (referring to FIG. 3A), spray coating (referring to FIG. 3B), artificial coating (referring to FIG. 3C), sticking (referring to FIG. 3D), impregnating (referring to FIG. 3E) or mask coating (referring to FIG. 3F).

Figure 4:
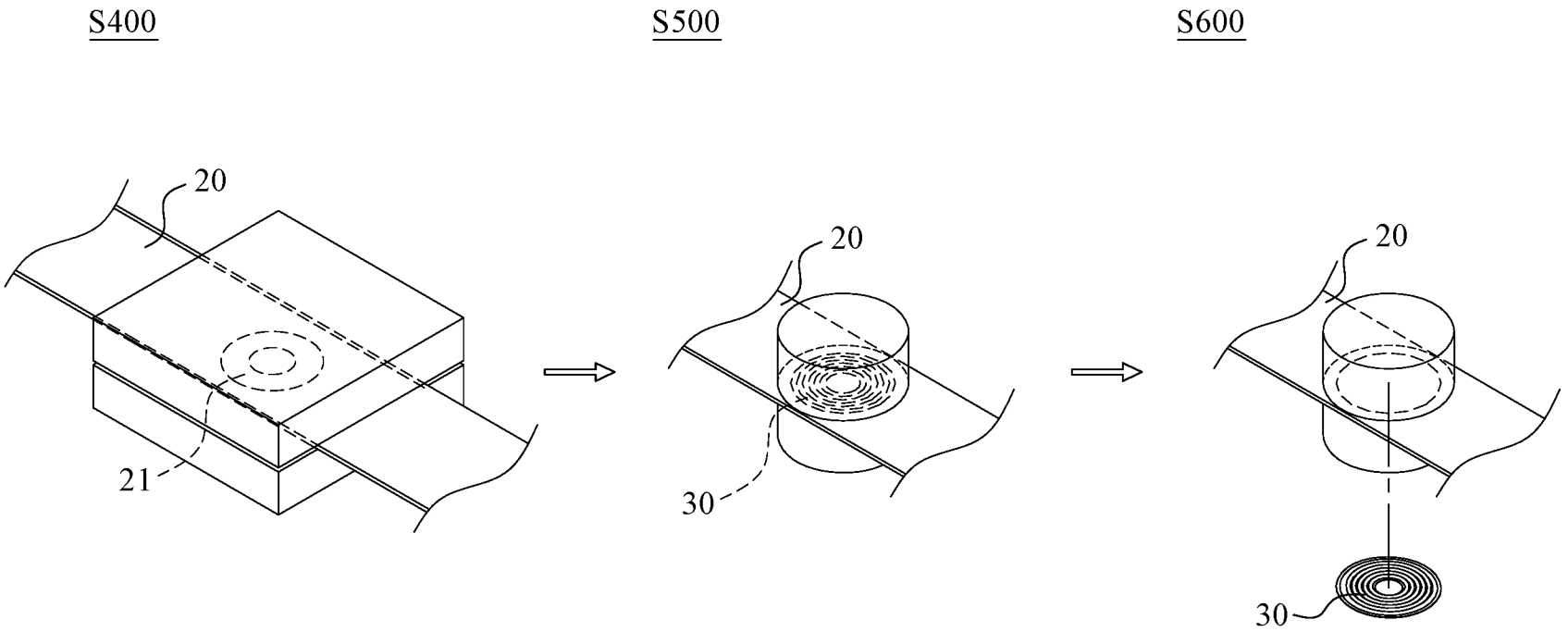

In the step S400, as shown in FIGS. 1 and 4, the base material 20 is dried, such that the elastic soft polymer 11 is dried to form an elastic soft structure 33 (referring to FIGS. 5 to 10) covering all or partial areas on the outer surface of the hard structure 32.

The steps S300 and S400 are performed only once or repeated a plurality of times, so as to form a single layer or a plurality of layers of elastic soft structure 33 covering all or partial areas on the outer surface of the hard structure 32.

In the step S500, as shown in FIGS. 1 and 4, the preformed portions 21 is heated and pressed to form a plurality of loudspeaker vibrating membranes 30.

In the step S600, as shown in FIGS. 1 and 4, the loudspeaker vibrating membranes 30 are separated from the base material 20.

It is noted that as shown in FIG. 1, the steps S300 and S400 can also be performed between the steps S500 and S600, or after the step S600. Therefore, no matter whether the steps S300 and S400 are performed between the steps S200 and S500, between the steps S500 and S600, or after the step S600, the manufactured loudspeaker vibrating membranes 30 are the same in terms of structure.

FIGS. 5 to 10 are schematic views of six aspects of the first embodiment of the loudspeaker vibrating membrane 30 of the present invention. As shown in FIGS. 5 to 10, the present invention provides loudspeaker vibrating membranes 30A to 30F, each having hard property and elastic soft property and comprising a main body 31, a hard structure 32 and an elastic soft structure 33, respectively. The hard structure 32 is formed by drying a curable polymer 10 and covers all areas on an outer surface of the main body 31. A single layer or plurality of layers of elastic soft structure 33 is(are) formed by drying an elastic soft polymer 11 and cover(s) all or partial areas on an outer surface of the hard structure 32.

As shown in FIGS. 5 to 10, the six aspects of the first embodiment have the commonality in that the hard structure 32 is formed by drying the curable polymer 10 and covers all areas on the outer surface of the main body 31. Accordingly, the hard structure 32 can exhibit the hard characteristics of the curable polymer, which imparts hard property to the entire main body 31, thereby increasing the hardness of the entire main body 31. Therefore, the loudspeaker vibrating membranes 30A to 30F are capable of generating vibration when receiving the operation of the voice coil.

Hereinafter, the differences among the six aspects of the first embodiment in terms of method, structure and effect will be further illustrated with reference to the drawings.

Aspect 1

In terms of method, in the step S300, the elastic soft polymer 11 adheres to the outer surface of the hard structure 32 located on the upper surface of an outer annular area of the preformed portion 21; in the step S400, the elastic soft structure 33 covers the outer surface of the hard structure 32 located on the upper surface of the outer annular area of the preformed portion 21; and the steps S300 and S400 are performed only once, so as to form a single layer of elastic soft structure 33, which covers the outer surface of the hard structure 32 located on the upper surface of the outer annular area of the preformed portion 21.

Figure 5:
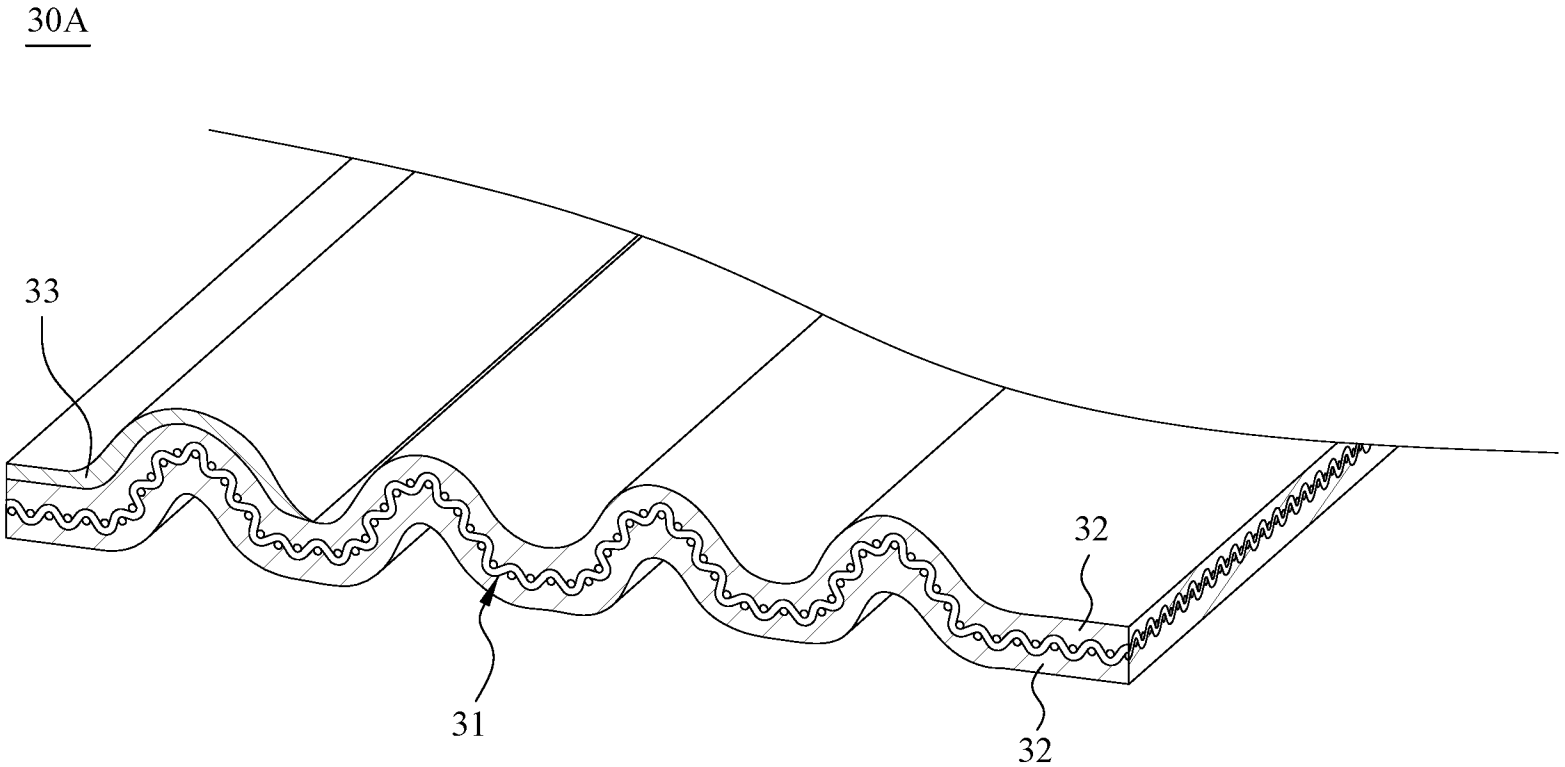
FIGS. 5 to 10 are schematic views of six aspects of the first embodiment of the loudspeaker vibrating membrane of the present invention.

In terms of structure, as shown in FIG. 5, the single layer of elastic soft structure 33 covers the outer surface of the hard structure 32 located on the upper surface of the outer annular area of the main body 31.

In terms of effect, the elastic soft structure 33 can exhibit the elastic soft characteristic of the elastic soft polymer, which imparts soft property to the outer annular area of the main body 31, such that the hardness of the outer annular area of the main body 31 is less than those of the other areas of the main body 31; meanwhile, the elastic coefficient of the outer annular area of the main body 31 is increased, such that the elastic coefficient of the outer annular area of the main body 31 is greater than those of the other areas of the main body 31. Accordingly, the outer annular area of the loudspeaker vibrating membrane 30A has excellent fatigue resistance and elastic resilience. The excellent fatigue resistance can prevent the outer annular area of the loudspeaker vibrating membrane 30A from being ruptured, deformed and peeled off easily; while the excellent elastic resilience enables the outer annular area of the loudspeaker vibrating membrane 30A to have the effects such as reducing resonance noise, reducing noise, easy displaying of sound channel at low frequency, and increasing loaded resilience; thereby improving the output sound quality of the loudspeaker.

Aspect 2

In terms of method, the step S300 includes the following steps: adhering the elastic soft polymer 11 to the outer surface of the hard structure 32 located on the upper surface of an outer annular area of the preformed portion 21, and adhering the elastic soft polymer 11 to the outer surface of the hard structure 32 located on the upper surface of all areas of the preformed portion 21, wherein the materials of the elastic soft polymers 11 used in the two times of coating in the step S300 are the same, thereby the thickness of the outer annular area of the elastic soft polymer 11 is greater than those of the other areas of the elastic soft polymer 11; in the step S400, the elastic soft structure 33 covers the outer surface of the hard structure 32 located on the upper surface of all areas of the preformed portion 21, thereby the thickness T1 of the outer annular area of the elastic soft structure 33 is greater than the thickness T2 of the other areas of the elastic soft structure 33; and the steps S300 and S400 are performed only once, so as to form a single layer of elastic soft structure 33, which covers the outer surface of the hard structure 32 located on the upper surface of all areas of the preformed portion 21.

Figure 6:
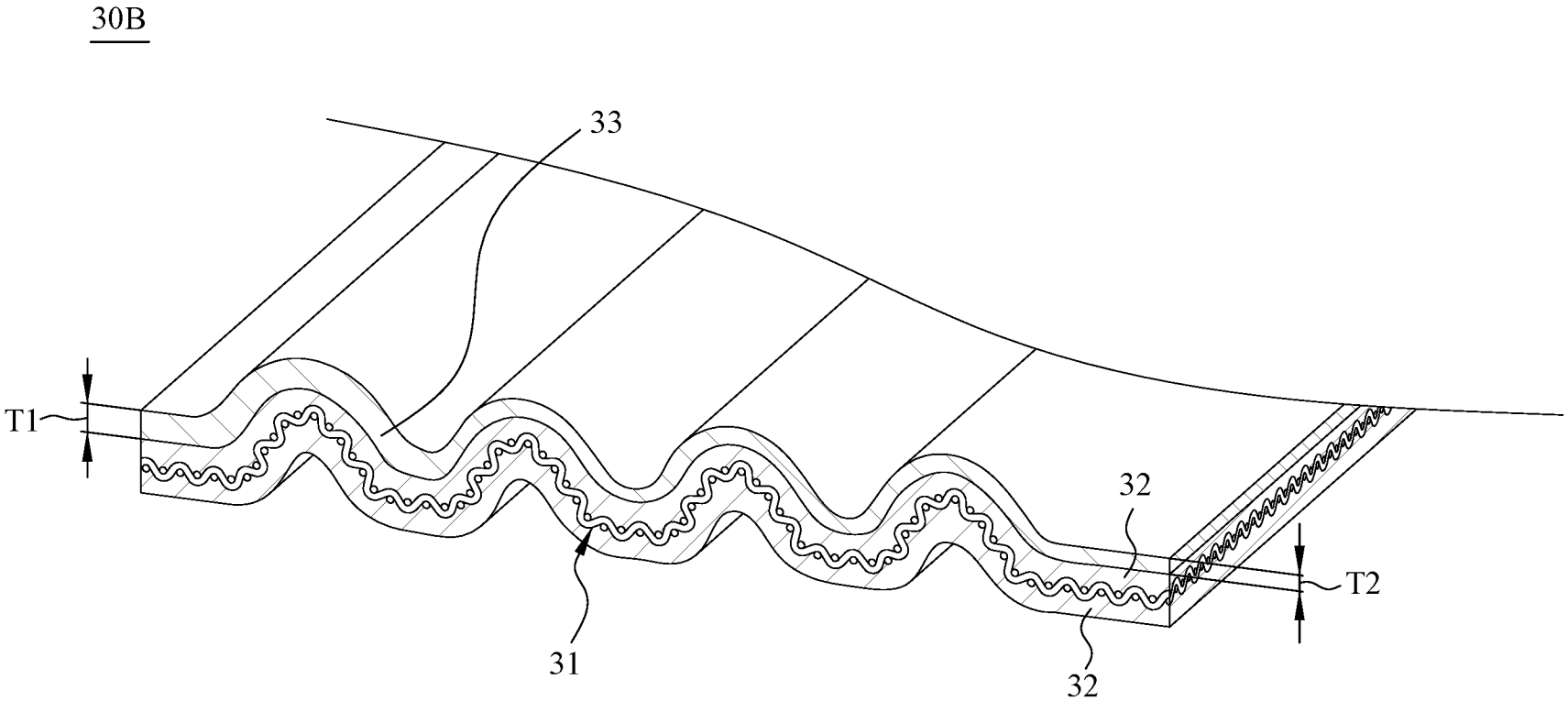

In terms of structure, as shown in FIG. 6, the single layer of elastic soft structure 33 covers the outer surface of the hard structure 32 located on the upper surface of all areas of the main body 31.

In terms of effect, firstly, the elastic soft structure 33 can exhibit the elastic soft characteristic of the elastic soft polymer, which imparts soft property to the entire main body 31, thereby decreasing the hardness of the entire main body 31 and increasing the elastic coefficient of the entire main body 31. Secondly, since the thickness T1 of the outer annular area of the elastic soft structure 33 is greater than the thickness T2 of the other areas of the elastic soft structure 33, the effect of imparting soft property to the outer annular area of the main body 31 is better than those to the other areas of the main body 31. In addition, the effect of increasing the elastic coefficient of the outer annular area of the main body 31 is better than those of the other areas of the main body 31, therefore, the hardness of the outer annular area of the main body 31 is less than those of the other areas of the main body 31, and the elastic coefficient of the outer annular area of the main body 31 is greater than those of the other areas of the main body 31. Accordingly, the other areas of the loudspeaker vibrating membrane 30B has excellent fatigue resistance and elastic resilience, while the outer annular area of the loudspeaker vibrating membrane 30B has more excellent fatigue resistance and elastic resilience. The excellent fatigue resistance can prevent the loudspeaker vibrating membrane 30B from being ruptured, deformed and peeled off easily; while the excellent elastic resilience enables the loudspeaker vibrating membrane 30B to have the effects such as reducing resonance noise, reducing noise, easy displaying of sound channel at low frequency, and increasing loaded resilience; thereby improving the output sound quality of the loudspeaker. In terms of performance of the aforementioned effects, the outer annular area of the loudspeaker vibrating membrane 30B is more excellent than the other areas of the loudspeaker vibrating membrane 30B.

Aspect 3

In terms of method, Aspect 3 is different from Aspect 2 of the first embodiment in that: (1) the materials of the elastic soft polymers 11 used in the two times of coating in the step S300 are different, wherein the elastic soft polymer 11 of the first time of coating is defined as an inner layer, and the elastic soft polymer 11 of the second time of coating is defined as an outer layer; (2) in the step S400, the inner layer of the elastic soft polymer 11 is dried to form an inner layer 331 of the elastic soft structure 33, and the outer layer of the elastic soft polymer 11 is dried to form an outer layer 332 of the elastic soft structure 33.

Figure 7:
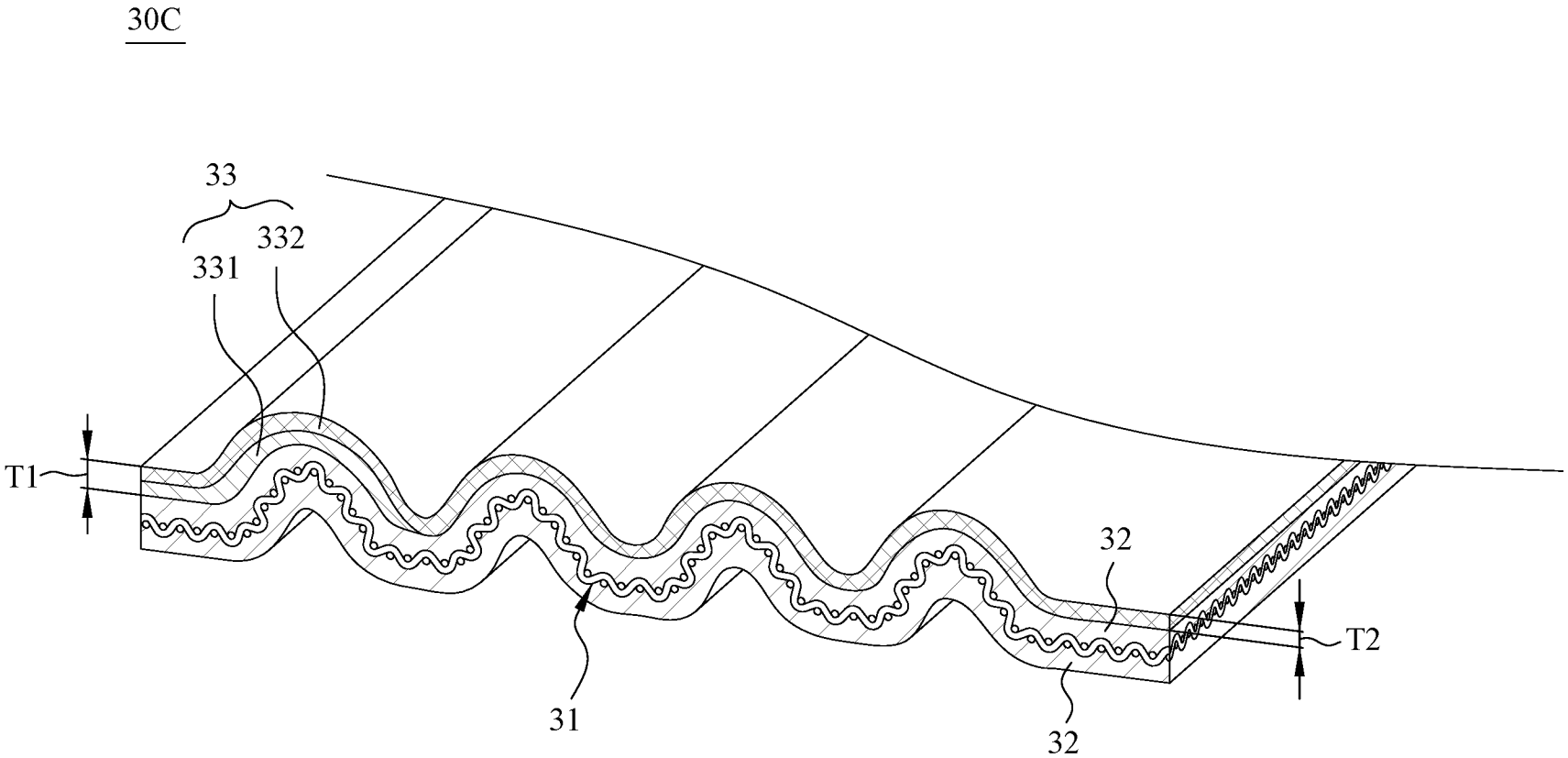

In terms of structure, as shown in FIG. 7, a single inner layer 331 covers the outer surface of the hard structure 32 located on the upper surface of the outer annular area of the main body 31, and a single outer layer 332 covers the outer surface of the hard structure 32 located on the upper surface of all areas of the main body 31.

In terms of effect, Aspect 3 is different from Aspect 2 of the first embodiment in that: the inner layer 331 and the outer layer 332 formed by drying two types of elastic soft polymer 11 of different materials can provide different soft imparting effect and elasticity increasing effect on the loudspeaker vibrating membrane 30C.

Aspect 4

In terms of method, Aspect 4 is different from Aspect 2 of the first embodiment in that: (1) in the first time of coating of the step S300, the elastic soft polymer 11 adheres to the outer surface of the hard structure 32 located on the upper surface of all areas of the preformed portion 21, while in the second time of coating of the step S300, the elastic soft polymer 11 adheres to the outer surface of the hard structure 32 located on the lower surface of two partial areas of the outer annular area of the preformed portion 21; (2) the materials of the elastic soft polymers 11 used in the two times of coating in the step S300 are different, wherein the elastic soft polymer 11 of the first time of coating is defined as an upper layer, and the elastic soft polymer 11 of the second time of coating is defined as a lower layer; (3) in the step S400, the upper layer of the elastic soft polymer 11 is dried to form an upper layer 333 of the elastic soft structure 33, and the lower layer of the elastic soft polymer 11 is dried to form a lower layer 334 of the elastic soft structure 33.

Figure 8:
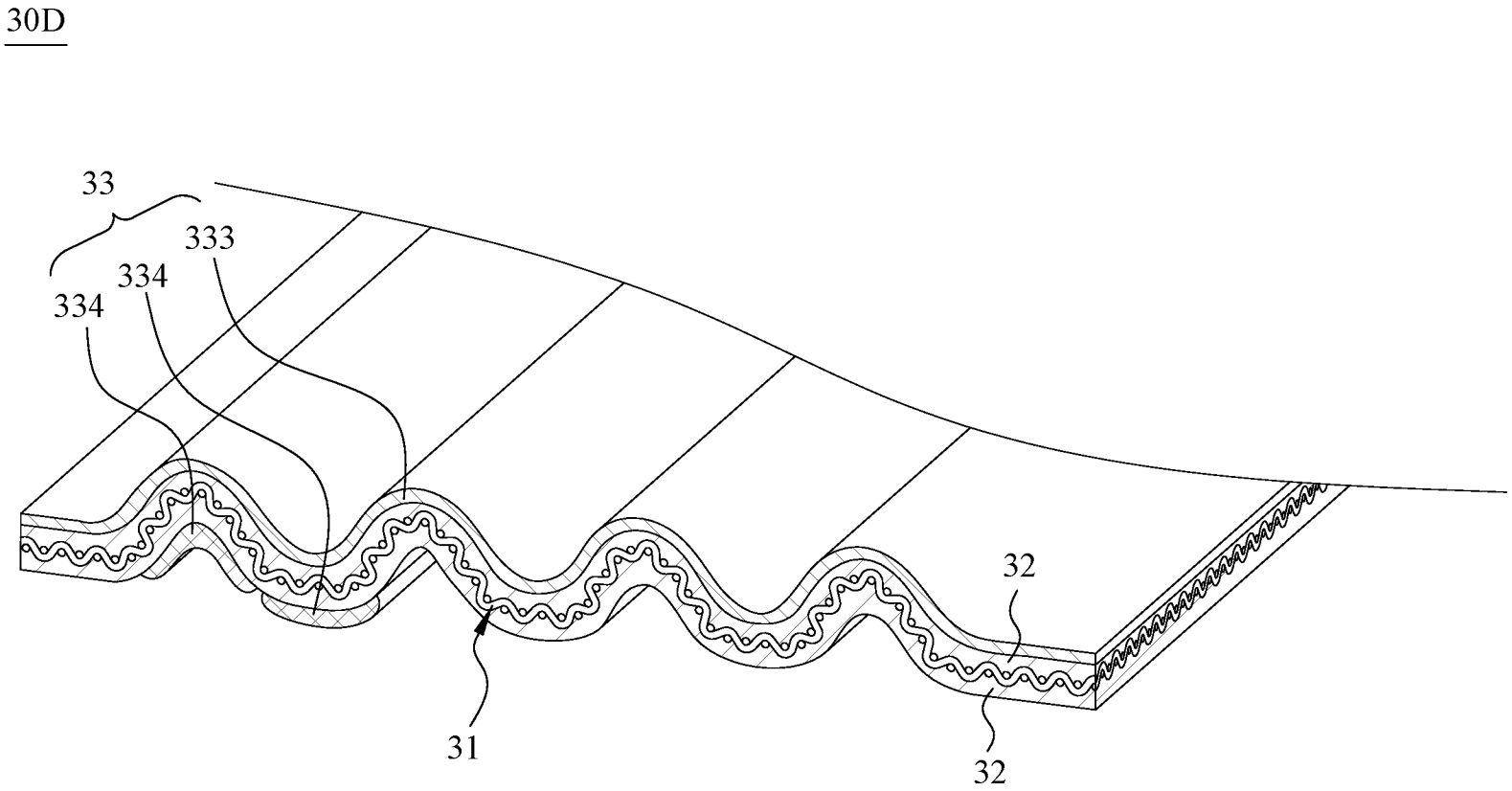

In terms of structure, as shown in FIG. 8, a single upper layer 333 covers the outer surface of the hard structure 32 located on the upper surface of all areas of the main body 31, and a single lower layer 334 covers the outer surface of the hard structure 32 located on the lower surface of two partial areas of the outer annular area of the main body 31.

In terms of effect, Aspect 4 is different from Aspect 2 of the first embodiment in that: (1) the effect of imparting soft property to the two partial areas of the outer annular area of the main body 31 is better than those to the other areas of the main body 31; (2) the effect of increasing the elastic coefficient of the two partial areas of the outer annular area of the main body 31 is better than those of the other areas of the main body 31; (3) the upper layer 333 and the lower layer 334 formed by drying two types of elastic soft polymer 11 of different materials can provide different soft imparting effect and elasticity increasing effect on the loudspeaker vibrating membrane 30D. Accordingly, the other areas of the loudspeaker vibrating membrane 30D has excellent fatigue resistance and elastic resilience, while the two partial areas of the outer annular area of the loudspeaker vibrating membrane 30D has more excellent fatigue resistance and elastic resilience. The excellent fatigue resistance can prevent the loudspeaker vibrating membrane 30D from being ruptured, deformed and peeled off easily; while the excellent elastic resilience enables the loudspeaker vibrating membrane 30D to have the effects such as reducing resonance noise, reducing noise, easy displaying of sound channel at low frequency, and increasing loaded resilience; thereby improving the output sound quality of the loudspeaker. In terms of performance of the aforementioned effects, the two partial areas of the outer annular area of the loudspeaker vibrating membrane 30D is more excellent than the other areas of the loudspeaker vibrating membrane 30D.

Aspect 5

In terms of method, in the step S300, the outer surface of the hard structure 32 located on each of the upper and lower surfaces of all areas of the preformed portion 21 is adhered with the elastic soft polymer 11, respectively; in the step S400, the outer surface of the hard structure 32 located on each of the upper and lower surfaces of all areas of the preformed portion 21 is covered with the elastic soft structure 33, respectively; and the steps S300 and S400 are performed only once, so that the outer surface of the hard structure 32 located on each of the upper and lower surfaces of all areas of the preformed portion 21 is formed with a single layer of elastic soft structure 33 covering thereon, respectively.

Figure 9:
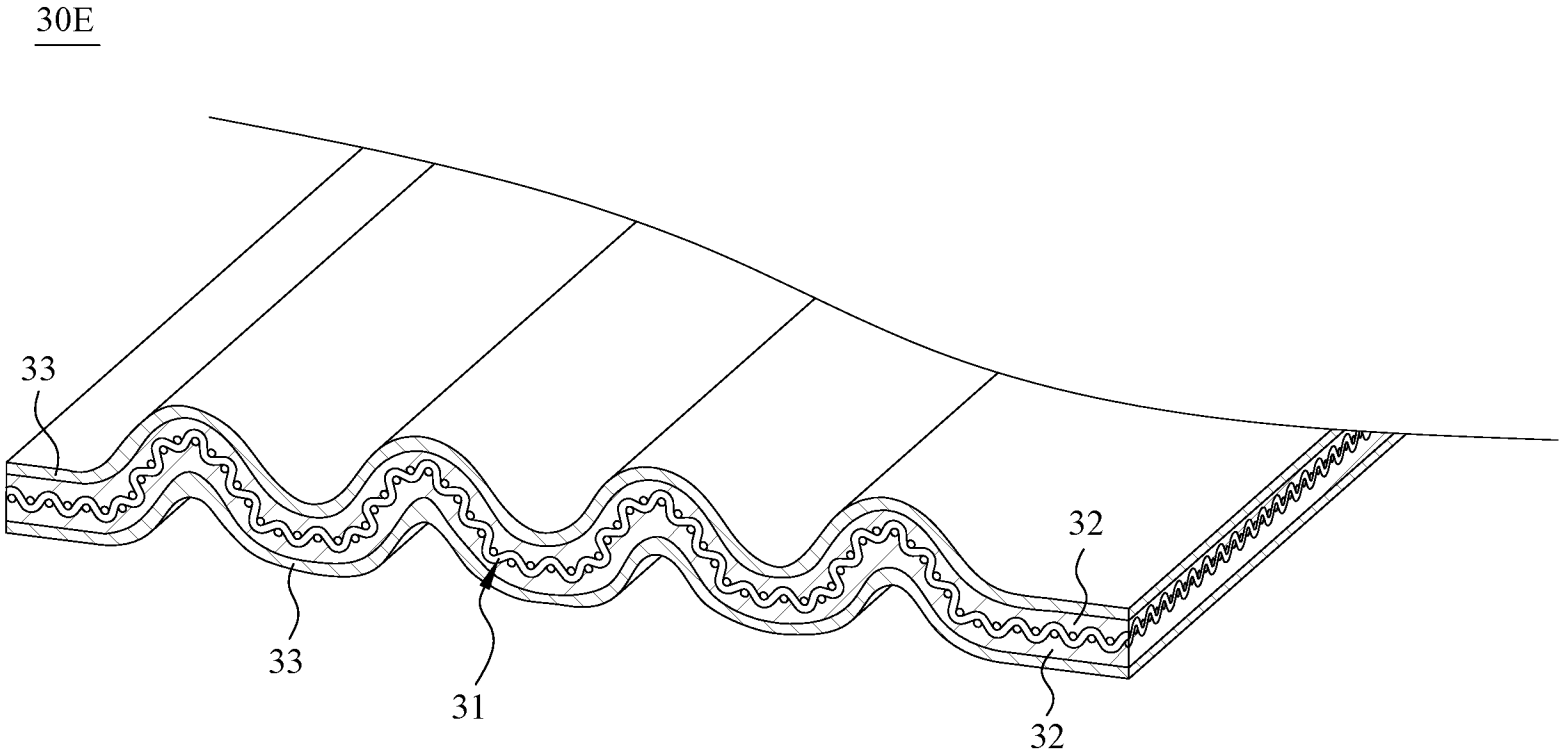

In terms of structure, as shown in FIG. 9, the outer surface of the hard structure 32 located on each of the upper and lower surfaces of all areas of the main body 31 is formed with a single layer of elastic soft structure 33 covering therein, respectively.

In terms of effect, the elastic soft structure 33 can exhibit the elastic soft characteristic of the elastic soft polymer, which imparts uniform soft property to the entire main body 31, thereby uniformly decreasing the hardness of the entire main body 31 and uniformly increasing the elastic coefficient of the entire main body 31. Accordingly, the entire loudspeaker vibrating membrane 30E has uniform and excellent fatigue resistance and elastic resilience. The uniform and excellent fatigue resistance can prevent the entire loudspeaker vibrating membrane 30E from being ruptured, deformed and peeled off easily; while the uniform and excellent elastic resilience enables the entire loudspeaker vibrating membrane 30E to have the effects such as reducing resonance noise, reducing noise, easy displaying of sound channel at low frequency, and increasing loaded resilience; thereby improving the output sound quality of the loudspeaker.

Aspect 6

In terms of method, Aspect 6 is different from Aspect 5 of the first embodiment in that: the steps S300 and S400 are repeated a plurality of times, so as to form a plurality of layers of elastic soft structure 33 covering all areas on the outer surface of the hard structure 32.

Figure 10:
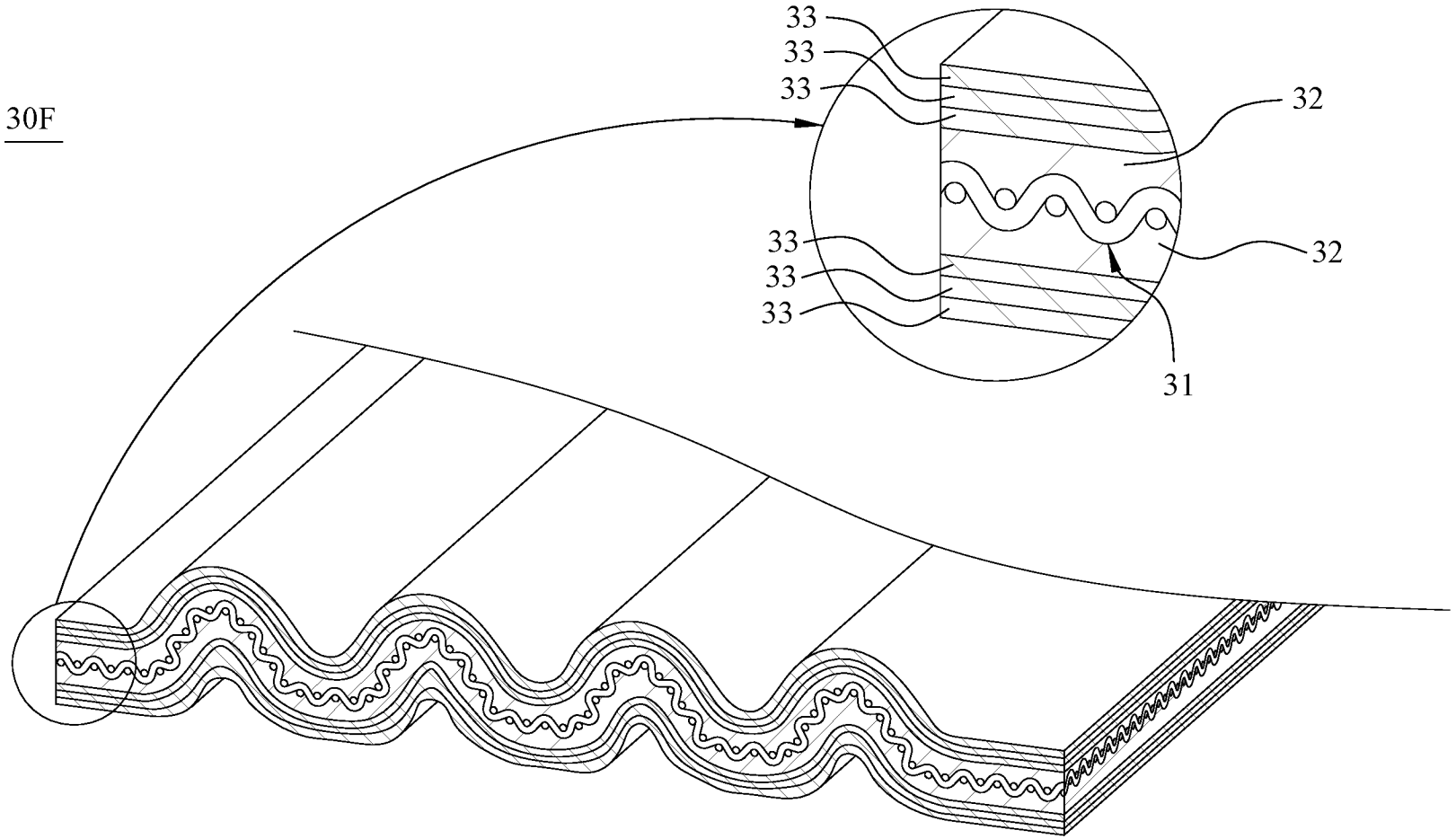

In terms of structure, as shown in FIG. 10, the outer surface of the hard structure 32 located on each of the upper and lower surfaces of all areas of the main body 31 is covered with a plurality of layers of elastic soft structure 33.

In terms of effect, the plurality of layers of elastic soft structure 33 can exhibit the elastic soft characteristic of the elastic soft polymer, which imparts further uniform soft property to the entire main body 31 and further increases the elastic coefficient of the entire main body 31, thereby, the hardness of the entire main body 31 is less than that of the entire main body 31 of Aspect 5 of the first embodiment. In addition, the elastic coefficient of the entire main body 31 of Aspect 6 of the first embodiment is greater than that of the entire main body 31 of Aspect 5 of the first embodiment. Accordingly, compared to the loudspeaker vibrating membrane 30E, the loudspeaker vibrating membrane 30F have more excellent fatigue resistance and elastic resilience, which further prevent the loudspeaker vibrating membrane 30F from being ruptured, deformed and peeled off easily; while the loudspeaker vibrating membrane 30D has more significant effects such as reducing resonance noise, reducing noise, easy displaying of sound channel at low frequency, and increasing loaded resilience; thereby, the effect of increasing the output sound quality of the loudspeaker is more excellent.

Figure 11:
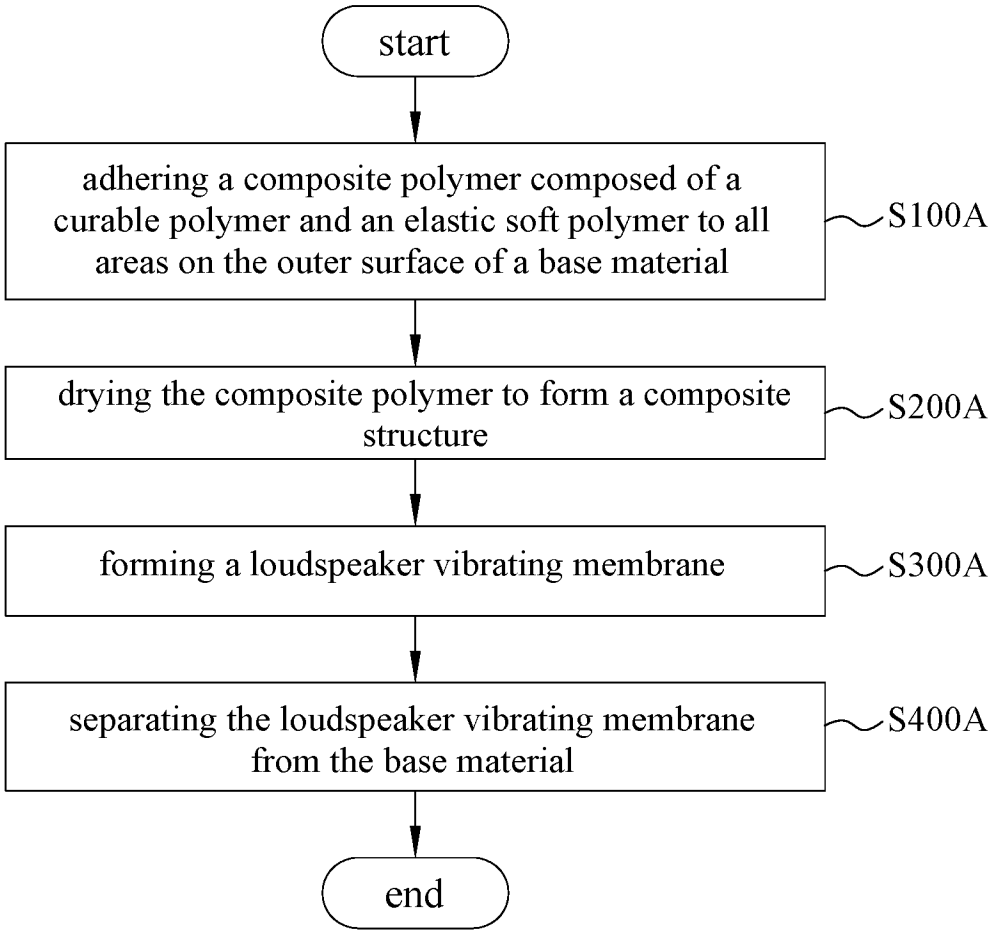
FIG. 11 is a flow chart of the second embodiment of the method of the present invention.
Figure 12:
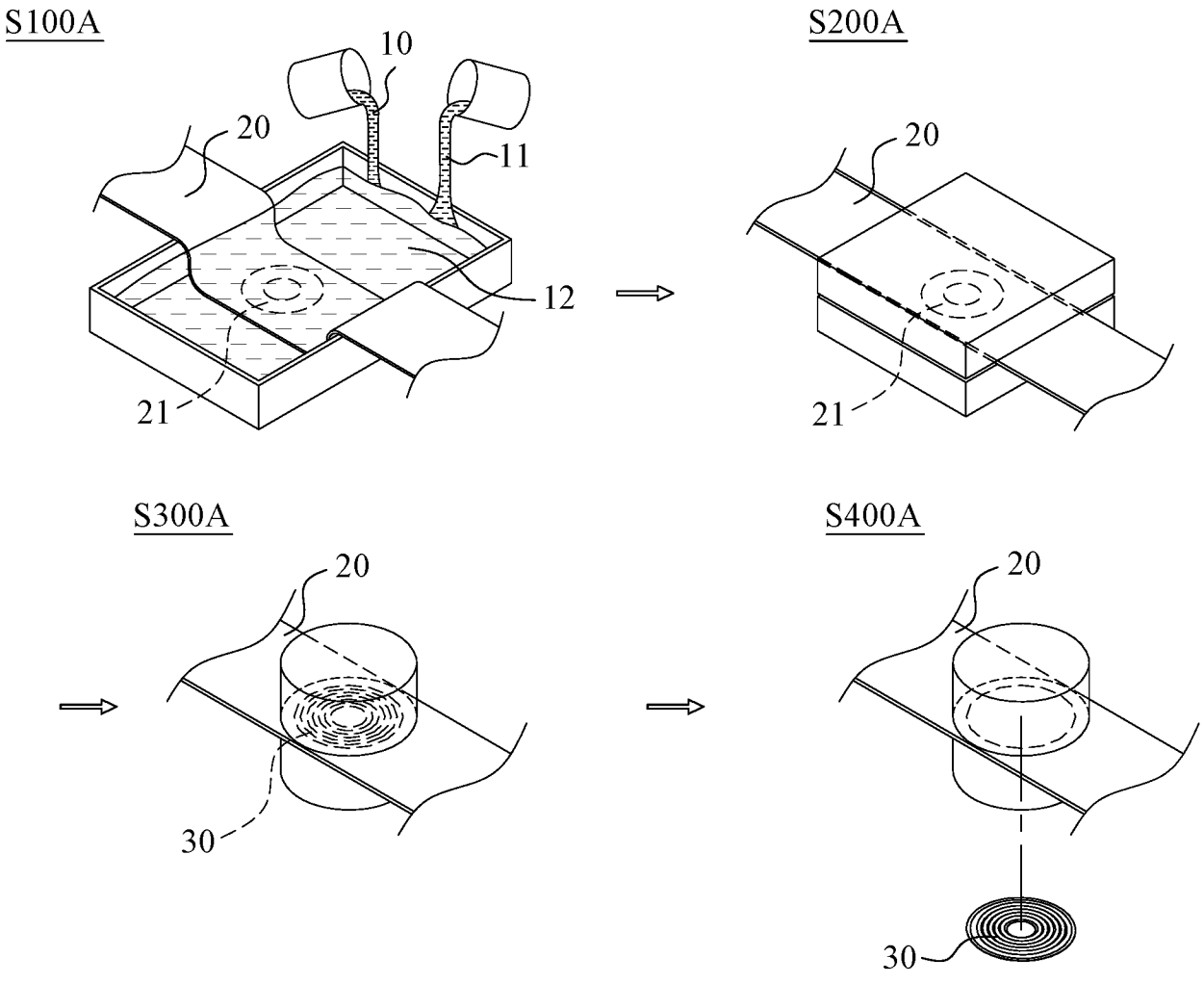
FIG. 12 is a schematic view of steps S100A to S400A of the second embodiment of the present invention.

FIG. 11 is a flow chart of the second embodiment of the method of the present invention, and FIG. 12 is a schematic view of steps S100A to S400A of the second embodiment of the present invention. As shown in FIGS. 11 and 12, the present invention provides a method for manufacturing a loudspeaker vibrating membrane with hard property and elastic soft property, comprising steps S100A to S400A.

In the step S100A, a composite polymer 12 is prepared by mixing a curable polymer 10 and an elastic soft polymer 11, and the composite polymer 12 adheres to all areas on an outer surface of a base material 20, wherein the base material 20 has a plurality of preformed portions 21.

In the step S200A, the base material 20 is dried, such that the composite polymer 12 is dried to form a composite structure 34 (referring to FIGS. 13 and 14) covering all areas on the outer surface of the base material 20.

The steps S100A and S200A are performed only once or repeated a plurality of times, so as to form a single layer or a plurality of layers of composite structure 34 covering all areas on the outer surface of the base material 20.

In the step S300A, the preformed portions 21 is heated and pressed to form a plurality of loudspeaker vibrating membranes 30.

In the step S400A, the loudspeaker vibrating membranes 30 are separated from the base material 20.

Figure 13:
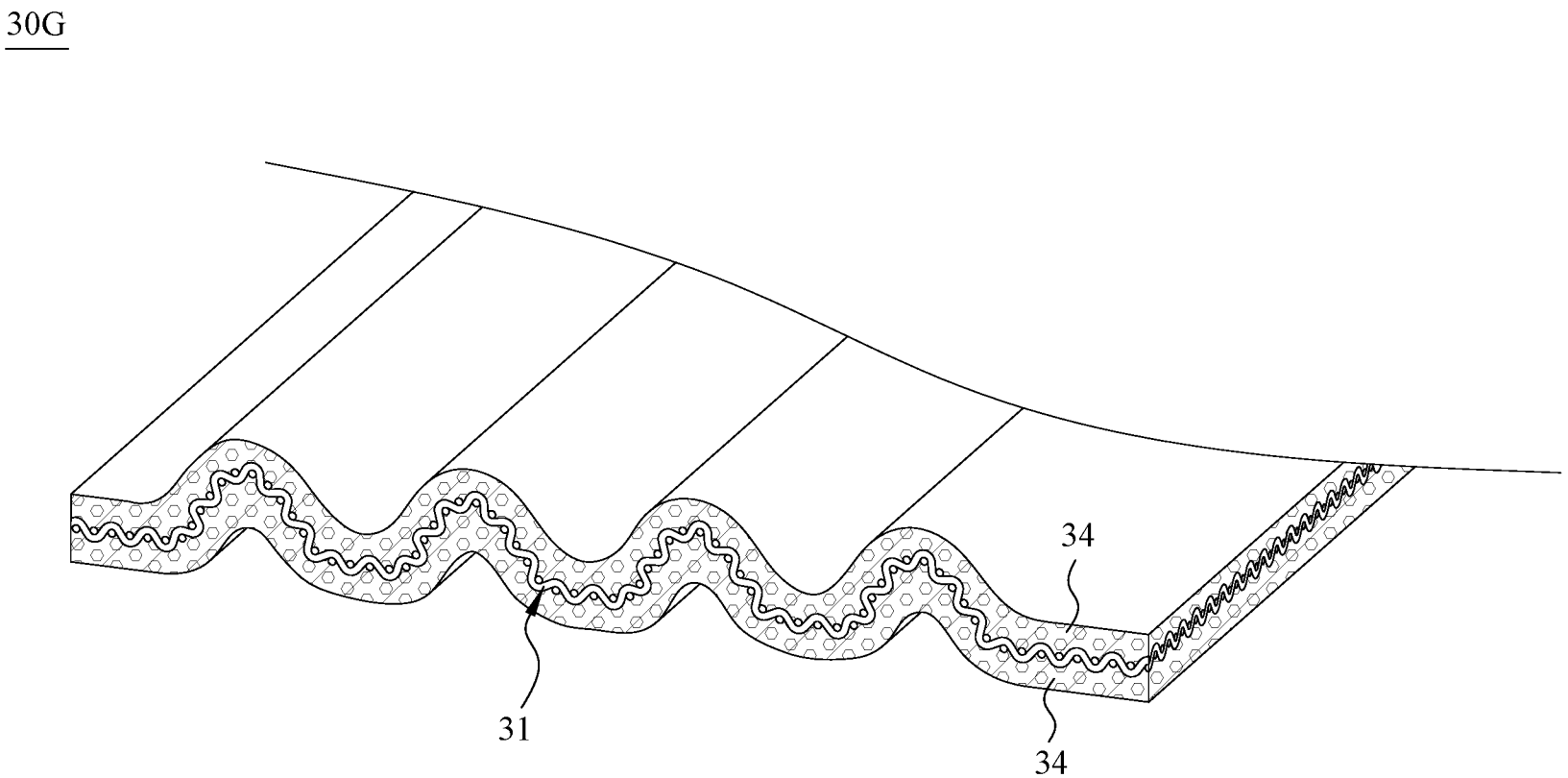
FIGS. 13 and 14 are schematic views of two aspects of the second embodiment of the loudspeaker vibrating membrane of the present invention.
Figure 14:
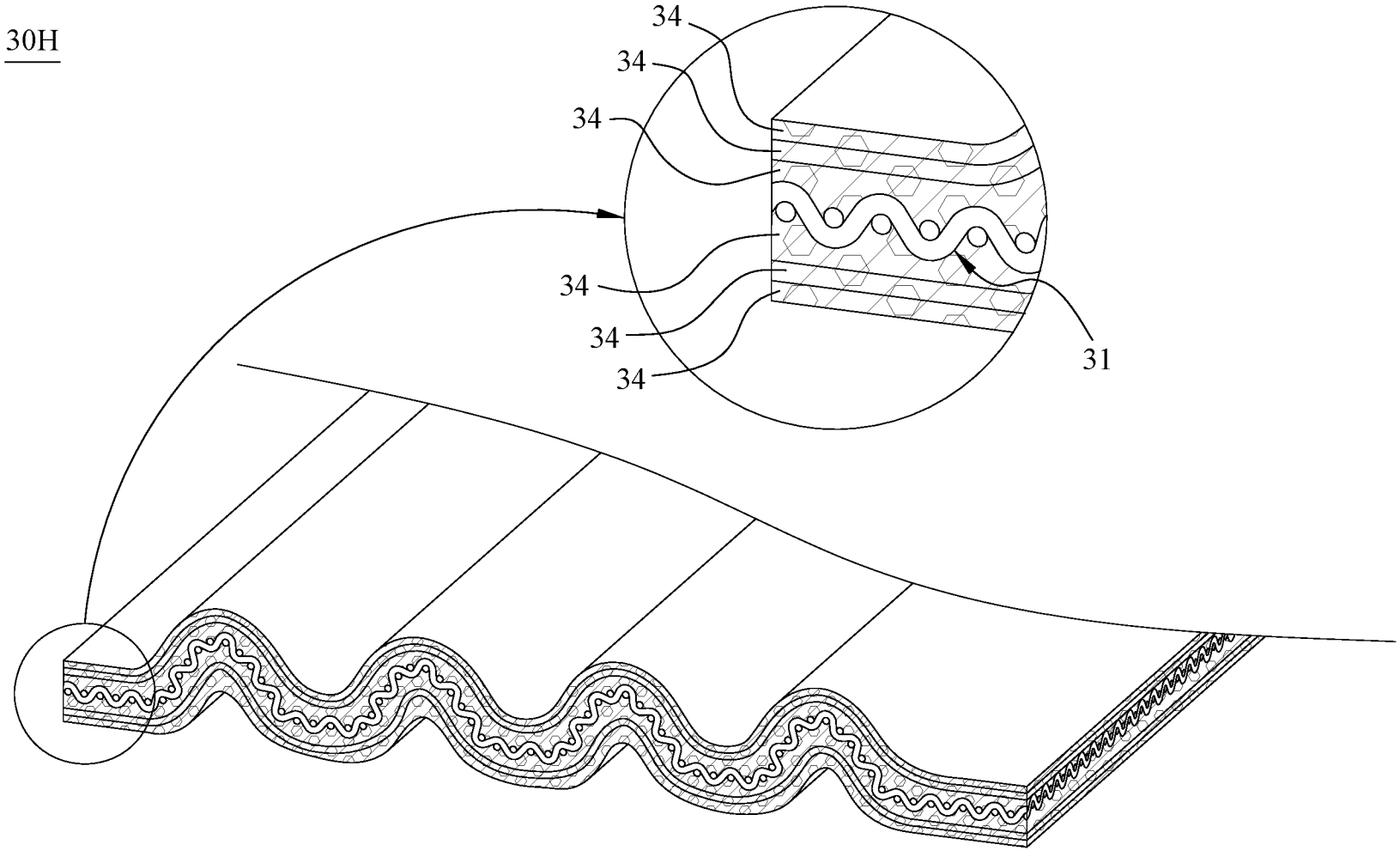

FIGS. 13 and 14 are schematic views of two aspects of the second embodiment of the loudspeaker vibrating membrane 30 of the present invention. As shown in FIGS. 13 and 14, the present invention provides loudspeaker vibrating membranes 30G and 30H, each having hard property and elastic soft property and comprising a main body 31 and a composite structure 34, respectively. A single layer or plurality layers of composite structure 34 is(are) formed by drying a composite polymer 12 and covers all areas on an outer surface of the main body 31. The composite polymer 12 is composed of a curable polymer 10 and an elastic soft polymer 11.

Hereinafter, the differences between the two aspects of the second embodiment in terms of method, structure and effect will be further illustrated with reference to the drawings.

Aspect 1

In terms of method, the steps S100A and S200A are performed only once, so as to form a single layer of composite structure 34 covering all areas on the outer surface of the base material 20. In terms of structure, as shown in FIG. 13, the single layer of composite structure 34 covers all areas on the outer surface of the base material 20. In terms of effect, firstly, the composite structure 34 can exhibit the hard characteristics of the curable polymer, which imparts hard property to the entire main body 31, thereby increasing the hardness of the entire main body 31. Therefore, the loudspeaker vibrating membrane 30 is capable of generating vibration when receiving the operation of the voice coil. Secondly, the composite structure 34 can exhibit the elastic soft characteristic of the elastic soft polymer, which imparts uniform soft property to the entire main body 31, thereby uniformly decreasing the hardness of the entire main body 31 and uniformly increasing the elastic coefficient of the entire main body 31. Accordingly, the loudspeaker vibrating membrane 30G can obtain the same fatigue resistance and elastic resilience as the loudspeaker vibrating membrane 30E, thereby achieving the same effect.

Aspect 2

In terms of method, the steps S100A and S200A are repeated a plurality of times, so as to form a plurality of layers of composite structure 34 covering all areas on the outer surface of the base material 20. In terms of structure, as shown in FIG. 14, the plurality of layers of composite structure 34 covers all areas on the outer surface of the base material 20, therefore, the thickness of the loudspeaker vibrating membrane 30H is greater than that of the loudspeaker vibrating membrane 30G. In terms of effect, the loudspeaker vibrating membrane 30H is completely the same as the loudspeaker vibrating membrane 30G.

In some embodiments, the curable polymer is natural resin or synthetic resin, and the elastic soft polymer is natural rubber or synthetic rubber. The hard characteristic of the curable polymer means the hard characteristic of natural resin or synthetic resin, and the elastic soft characteristic of the elastic soft polymer means the elastic soft characteristic of the natural rubber or synthetic rubber.

In some embodiments, the elastic soft polymer is a solution of styrene-butadiene rubber and water, and the concentration of the styrene-butadiene rubber is 1 to 80 wt %. In other words, as long as the styrene-butadiene rubber concentration of the elastic soft polymer is 1 to 80 wt %, it is enough to appropriately increase the elasticity of the base material 20 and impart appropriate soft property to the base material 20, thereby providing an effect comparable to that of pure styrene-butadiene rubber (which has a concentration of 100 wt % and does not contain water) with a lower styrene-butadiene rubber concentration and a lower cost.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A method for manufacturing a loudspeaker vibrating membrane with hard property and elastic soft property, comprising the following steps:

(a) impregnating a base material in a curable polymer, such that the curable polymer adheres to all areas on an outer surface of the base material, wherein the base material has at least one preformed portion;

(b) drying the base material, such that the curable polymer is dried to form a hard structure covering all areas on the outer surface of the base material;

(c) performing heating and pressing on the at least one preformed portion to form a loudspeaker vibrating membrane; and (d) separating the loudspeaker vibrating membrane from the base material;

wherein, the method further comprises the following steps between the step (b) and the step (c), or between the step (c) and the step (d), or after the step (d):

(e) adhering an elastic soft polymer to all or partial areas on an outer surface of the hard structure by screen printing, spray coating, artificial coating, sticking, impregnating or mask coating, wherein the elastic soft polymer is a solution of styrene-butadiene rubber and water, and the concentration of the styrene-butadiene rubber is 1 to 80 wt %; and (f) drying the base material, such that the elastic soft polymer is dried to form an elastic soft structure covering all or partial areas on the outer surface of the hard structure.

2. The method according to claim 1, wherein the step (e) and the step (f) are performed only once or repeated a plurality of times, so as to form a single layer or a plurality of layers of the elastic soft structure covering all or partial areas on the outer surface of the hard structure.

3. A method for manufacturing a loudspeaker vibrating membrane with hard property and elastic soft property, comprising the following steps:

(a) mixing a curable polymer and an elastic soft polymer to prepare a composite polymer, and adhering the composite polymer to all areas on an outer surface of a base material, wherein the base material has at least one preformed portion, wherein the elastic soft polymer is a solution of styrene-butadiene rubber and water, and the concentration of the styrene-butadiene rubber is 1 to 80 wt %;

(b) drying the base material, such that the composite polymer is dried to form a composite structure covering all areas on the outer surface of the base material;

(c) performing heating and pressing on the at least one preformed portion to form a loudspeaker vibrating membrane; and (d) separating the loudspeaker vibrating membrane from the base material.

4. The method according to claim 3, wherein the step (a) and the step (b) are performed only once or repeated a plurality of times, so as to form a single layer or a plurality of layers of the composite structure covering all areas on the outer surface of the base material.

5. A loudspeaker vibrating membrane with hard property and elastic soft property, comprising:

a main body;

a hard structure, which is formed by drying a curable polymer and covers all areas on an outer surface of the main body; and an elastic soft structure, which is formed by drying an elastic soft polymer and covers all or partial areas on an outer surface of the hard structure;

wherein the elastic soft polymer is a solution of styrene-butadiene rubber and water, and the concentration of the styrene-butadiene rubber is 1 to 80 wt %.

6. The loudspeaker vibrating membrane according to claim 5, wherein a single layer or a plurality of layers of the elastic soft structure cover(s) all or partial areas on the outer surface of the hard structure.

7. A loudspeaker vibrating membrane with hard property and elastic soft property, comprising:

a main body; and a composite structure, which is formed by drying a composite polymer and covers all areas on an outer surface of the main body;

wherein, the composite polymer is composed of a curable polymer and an elastic soft polymer, the elastic soft polymer is a solution of styrene-butadiene rubber and water, and the concentration of the styrene-butadiene rubber is 1 to 80 wt %.

8. The loudspeaker vibrating membrane according to claim 7, wherein a single layer or a plurality of layers of the composite structure cover(s) all areas on the outer surface of the main body.

* * * * *